US007243592B2

(12) United States Patent
Moe

(10) Patent No.: US 7,243,592 B2
(45) Date of Patent: Jul. 17, 2007

(54) DRAINING OF OIL LEAK IN A HYDRAULIC CYLINDER

(75) Inventor: Magne Mathias Moe, Harstad (NO)

(73) Assignee: National Oilwell Norway AS (NO)

( * ) Notice: Subject to any disclaimer, the term of this patent is extended or adjusted under 35 U.S.C. 154(b) by 4 days.

(21) Appl. No.: 10/534,684

(22) PCT Filed: Nov. 11, 2003

(86) PCT No.: PCT/NO03/00380

§ 371 (c)(1),
(2), (4) Date: Sep. 16, 2005

(87) PCT Pub. No.: WO2004/044437

PCT Pub. Date: May 27, 2004

(65) Prior Publication Data

US 2006/0117944 A1 Jun. 8, 2006

(30) Foreign Application Priority Data

Nov. 12, 2002 (NO) ..... 20025408

(51) Int. Cl.
*F15B 15/14* (2006.01)
*F15B 20/00* (2006.01)

(52) U.S. Cl. ..... 92/86; 91/48

(58) Field of Classification Search ..... 92/86; 91/48, 50, 436; 60/369, 371, 372, 413, 414
See application file for complete search history.

(56) References Cited

U.S. PATENT DOCUMENTS

| | | | | |
|---|---|---|---|---|
| 3,293,994 | A | 12/1966 | Napolitano | |
| 3,986,437 | A | 10/1976 | Lioux | |
| 4,188,787 | A * | 2/1980 | Bromell et al. | 60/327 |
| 4,646,518 | A * | 3/1987 | Hochsattel | 60/413 |
| 4,707,993 | A * | 11/1987 | Kime | 60/372 |
| 4,887,515 | A | 12/1989 | Tabata | |
| 5,031,509 | A | 7/1991 | Cowan | |
| 5,743,716 | A * | 4/1998 | Smith | 60/371 |
| 6,374,723 | B1 | 4/2002 | Cook et al. | |

FOREIGN PATENT DOCUMENTS

| | | |
|---|---|---|
| DE | 41 33 188 | 4/1992 |
| DE | 191 34 155 | 1/2002 |
| GB | 1 260 803 | 1/1970 |

* cited by examiner

*Primary Examiner*—Igor Kershteyn
(74) *Attorney, Agent, or Firm*—Andrus, Sceales, Starke & Sawall, LLP

(57) ABSTRACT

A device for a single-acting hydraulic cylinder (1) designed to lift or pull a load upon the existence of an oil pressure on the rod-side of a cylinder piston (7), where the cylinder bottom (15) of the hydraulic cylinder (1) is provided with a drainage outlet (27) for leakage fluid, as well as an air inlet (29).

16 Claims, 2 Drawing Sheets

DRAINING OF OIL LEAK IN A HYDRAULIC CYLINDER

CROSS REFERENCE TO RELATED APPLICATION

The present application is the U.S. national stage application of International Application PCT/NO2003/000380, filed Nov. 11, 2003, which international application was published on May 24, 2004 as International Publication WO 2004/044437. The International Application claims priority of Norwegian Patent Application 20025408, filed Nov. 12, 2002.

This invention regards a device for draining an oil leakage between a piston and a cylinder wall in a hydraulic cylinder, in particular in a single-acting vertical cylinder designed to pull a load through the action of hydraulic pressure, and where the lead-through for the piston rod is located at the upper end of the cylinder.

Hydraulic cylinders that operate more or less continuously, while at the same time being installed in an inaccessible location as regards daily inspections and in surroundings where oil leak is undesirable for environmental reasons, e.g. cylinders used to maintain the prescribed tension in a riser between a subsea borehole for petroleum production and a floating platform, are expensive to maintain when all safety regulations and pollution requirements are to be complied with. Frequent operation calls for extensive maintenance, while inaccessible placement results in complicated operations to gain access to the components, and maintenance will often cause a stoppage in the ordinary production in the plant.

With a functional system for drainage and collection of oil leaking from the cylinders, a greater leakage can be tolerated before the cylinders must be serviced. A longer maintenance interval means a great potential for financial profit. In addition, a secure method of collecting leaked oil will entail environmental profits.

The object of the invention is to remedy the disadvantages of prior art.

BACKGROUND OF THE INVENTION

The object is achieved by the characteristics stated in the description below and in the following claims.

A single-acting, vertically mounted hydraulic cylinder of a type that is known per se has a protruding cylinder rod at the upper end of the cylinder. The piston rod is provided with a piston according to prior art. The piston rod lead-through through the gable wall of the cylinder, and the piston, are provided with suitable seals according to prior art.

Advantageously, the cylinder is supplied with oil through an axial cylindrical passage disposed centrally in the piston rod.

The cylinder is designed to lift a load when connected to a hydraulic system that is known per se and when hydraulic pressure is established in a space above a piston in the cylinder.

A bottom plate that fits tightly at a lower end of the cylinder is provided with a drainage channel. The drainage channel is connected, by means of techniques that are known per se, with a reservoir for collection of oil that is drained from a space between the cylinder piston and the bottom of the cylinder.

The bottom of the cylinder is provided with a shoulder for the piston, so as to leave a space between the piston and the cylinder bottom when the piston is pushed fully into the cylinder.

The bottom plate of the cylinder is provided with an air inlet that projects slightly from the bottom, at the most to the level of the piston shoulder in the cylinder bottom. The air inlet is connected, by means of techniques that are known per se, with a compressed-air plant that is known per se.

When using the cylinder of the invention, hydraulic pressure is introduced at the top of the cylinder piston. Over time, oil will leak between the cylinder wall and the piston seals. The leaking oil collects at the bottom of the cylinder, from where it is drained via said drainage channel. By using said compressed-air plant, the space between the piston and the cylinder bottom is pressurized to a slight overpressure, typically 1.5 bar. As a result of this overpressure the leaking oil will drain to a reservoir which may be placed in a, for this, favourable location high above the cylinder, e.g. on a deck of an oil installation.

BRIEF DESCRIPTION OF THE DRAWINGS

The following describes a non-limiting example of a preferred embodiment illustrated in the accompanying drawings, in which.

DETAILED DESCRIPTION OF THE INVENTION

Figure 1:
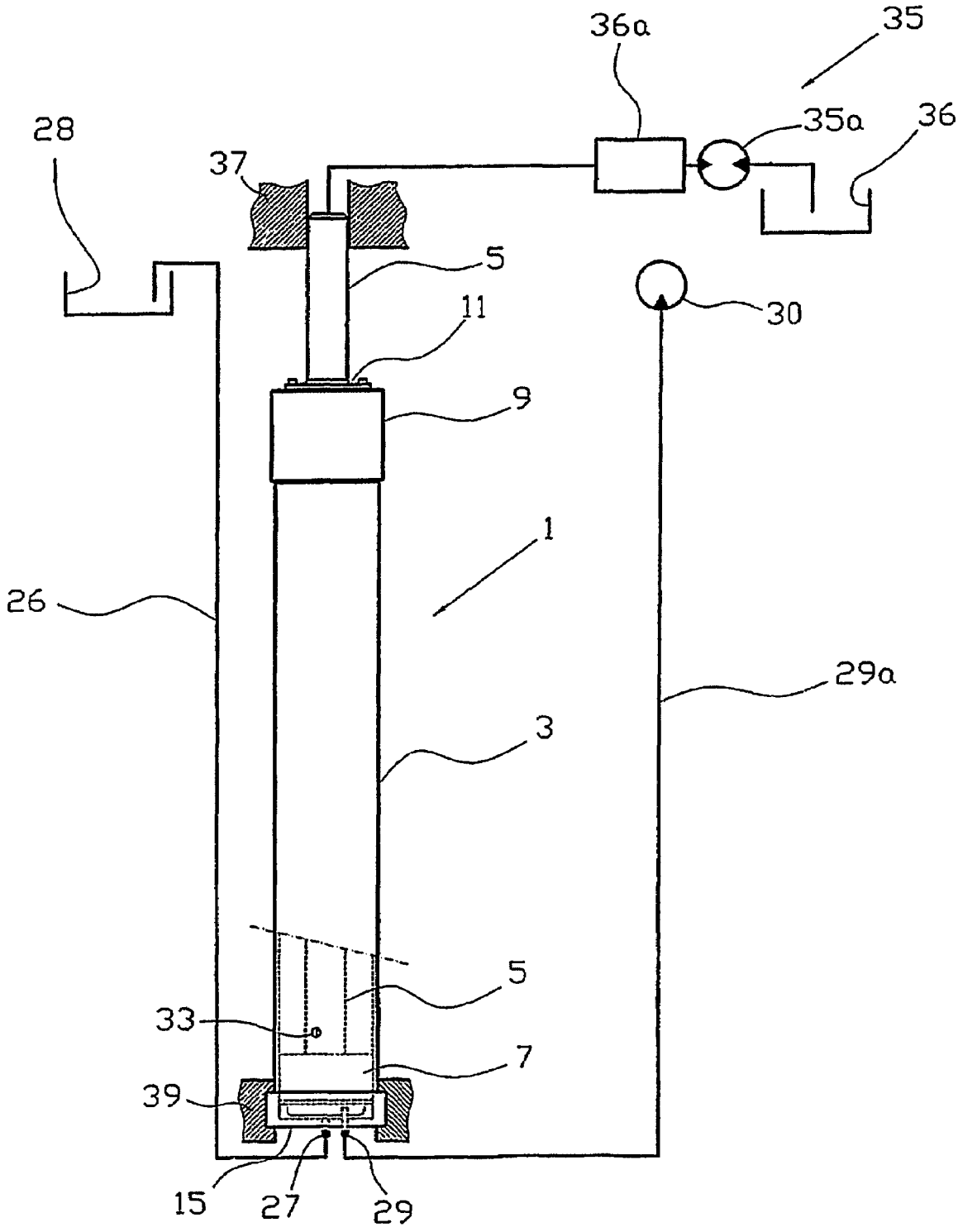
FIG. 1 schematically shows a cylinder according to the invention with an associated compressed-air plant and a reservoir for leaking oil.
Figure 2:
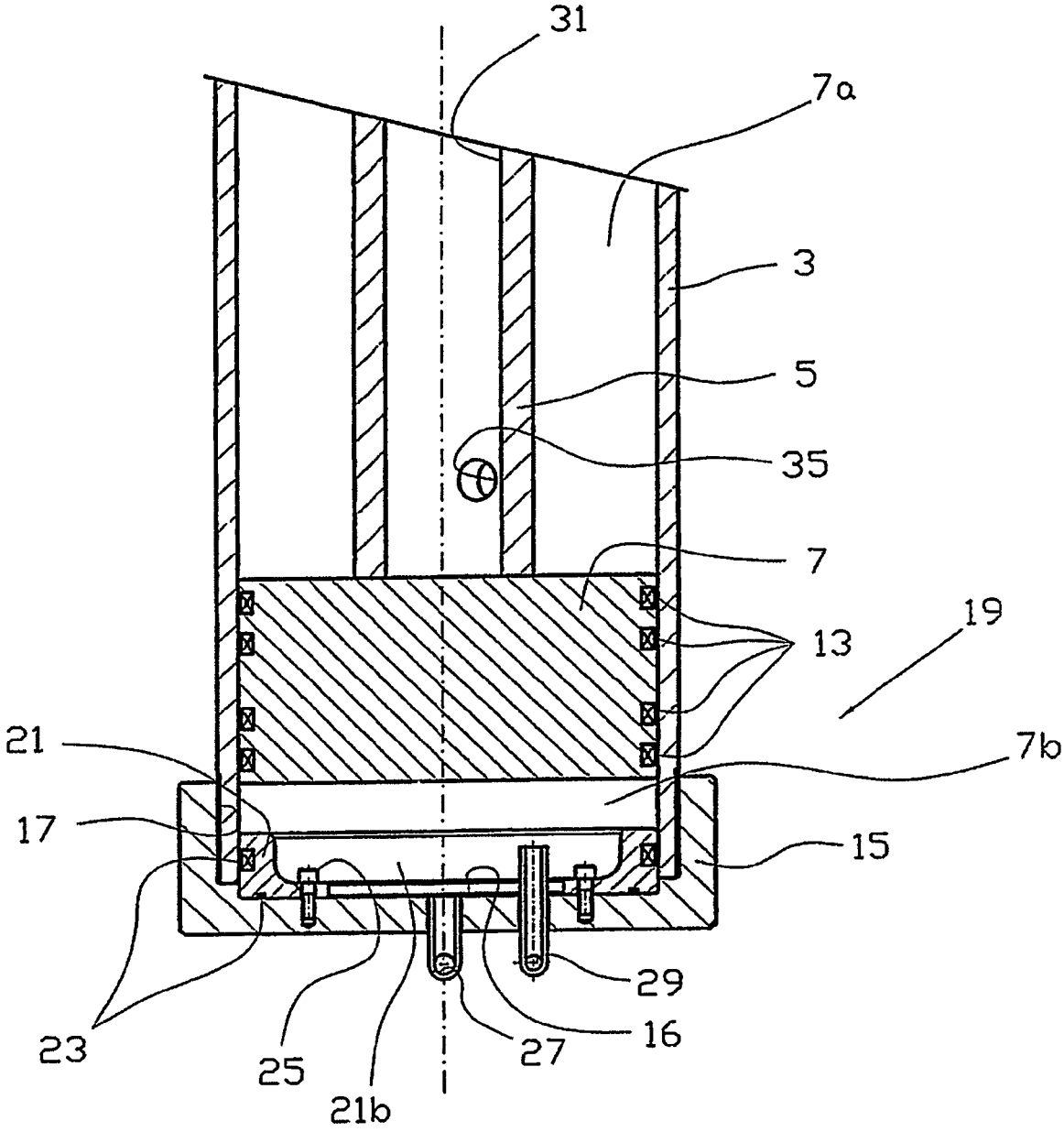
FIG. 2 is a longitudinal section through the lower part of the cylinder on a larger scale.

In the drawings, reference number 1 denotes a hydraulic cylinder in which 3 is a cylinder wall, 5 is a piston rod and 7 is a piston. The hydraulic cylinder 1 also comprises a cylinder gable 9 with associated seals 11. The piston 7 is provided with seals 13. The piston 7 divides the cylinder 1 into an upper space 7*a* on the rod-side of the piston 7 and a lower space 7*b*.

A cylinder bottom 15 is screwed onto a lower end 19 of the cylinder 1 by means of female threads 17. An annular piston shoulder 21 is placed on an inner wall surface 16 of the cylinder bottom 15. The piston shoulder 21 is provided with seals 23 and fixed to the bottom plate 15 by screws 25. The bottom plate 15 is provided with a drainage channel 27 and an air inlet 29. The air inlet 29 projects above the inner wall surface 16 of the bottom plate 15 at a height of approximately ⅔ of the height of the piston shoulder 21. The drainage channel 27 is connected with a reservoir 28 via suitable tubes 26. The air inlet 29 is connected with a compressed-air plant 30 via suitable tubes 29*a*.

The piston rod 5 has an axial, central passage 31 that connects the cylinder 1 with a hydraulic system 35 via bores 33, which hydraulic system comprises a pump 35*a*, a reservoir 36 and control device 36*a*.

The cylinder 1 is connected to a supporting structure 37 and a movable cast 39.

The hydraulic system 35 is designed to pressurize the upper cylinder space 7*a*, so that the cylinder 1 supports or moves the load 39 to which it is connected. The seals 13 are subjected to oil pressure. Any oil leak past the seals 13 pass the piston 7 and is collected at the bottom plate 15 of the cylinder 1. The space 7*b* below the piston 7 is connected to the compressed-air plant 30, which maintains a prescribed pressure, preferably between 1 and 2 bar. By means of said overpressure, any leaking oil that occurs in the lower cylinder space 7*b* is forced through channel 27 and tube 26 and up to the reservoir 28, in which the oil is collected, possibly to be sent back to the reservoir 36 of the hydraulic system 35.

The invention claimed is:

1. A device for a single-acting hydraulic cylinder designed to lift or pull a load upon the existence of an oil pressure on the rod-side of a cylinder piston, the bottom of the hydraulic cylinder being provided with a drainage outlet for leaking fluid, as well as an air inlet, the drainage outlet being connected to a reservoir for collection of leakage fluid, wherein the air inlet is connected with a compressed air reservoir adapted to continuously or periodically apply an overpressure to the lower cylinder space.

2. The device of claim 1, wherein the reservoir in the position of use is placed at a higher level than the bottom of the hydraulic cylinder.

3. The device of claim 1, wherein the bottom of the hydraulic cylinder is provided with a piston bearing surface which together with the cylinder piston forms a hollow space when the cylinder piston is in a lower position.

4. The device of claim 1, wherein the air inlet projects above the inner wall surface of the bottom of the cylinder.

5. A hydraulically actuated piston-cylinder device, the device comprising:

an elongated cylinder;

a piston disposed in the cylinder and being reciprocatable along a length of the cylinder, the piston separating the cylinder into first and second sealed chambers;

means for supplying pressurized oil to the first chamber;

means for discharging oil from the second chamber that leaked from the first chamber into the second chamber;

means for collecting the oil discharged from the second chamber; and means for supplying pressurized air to the second chamber.

6. The device of claim 5, wherein the means for supplying pressurized oil to the first chamber comprises an oil inlet connected to the first chamber.

7. The device of claim 5 wherein the means for discharging oil from the second chamber that leaked from the first chamber into the second chamber comprises an oil outlet connected to the second chamber.

8. The device of claim 5, wherein the oil outlet is in a bottom of the cylinder.

9. The device of claim 5, wherein the means for collecting the oil discharged from the second chamber comprises a reservoir connected to the oil outlet.

10. The device of claim 9, wherein the reservoir is positioned at a higher elevation than the bottom of the cylinder.

11. The device of claim 5, wherein the means for supplying pressurized air to the second chamber comprises an air inlet connected to the second chamber and a source of pressurized air connected to the air inlet.

12. The device of claim 11, wherein the air inlet is in a bottom of the cylinder.

13. The device of claim 12, wherein the air inlet projects above an inner wall surface of the cylinder bottom.

14. The device of claim 12, wherein the cylinder bottom comprises a piston bearing surface and wherein the piston bearing surface and piston define a hollow space when the piston bearing surface and piston are positioned proximate each other.

15. A device for a single-acting hydraulic cylinder designed to lift or pull a load upon the existence of an oil pressure on the rod-side of a cylinder piston, the cylinder bottom of the hydraulic cylinder being provided with a drainage outlet for leaking fluid, as well as an air inlet, wherein the reservoir in the position of use is placed at a higher level than the bottom of the cylinder.

16. A device for a single-acting hydraulic cylinder designed to lift or pull a load upon the existence of an oil pressure on the rod-side of a cylinder piston, the cylinder bottom of the hydraulic cylinder being provided with a drainage outlet for leaking fluid, as well as an air inlet, wherein the cylinder bottom of the hydraulic cylinder is provided with a piston bearing surface which forms a hollow space when the cylinder piston is in the lowered position.

* * * * *